US007285127B2

(12) United States Patent
Jewett

(10) Patent No.: US 7,285,127 B2
(45) Date of Patent: Oct. 23, 2007

(54) PACIFIER TOY

(75) Inventor: Amy Elizabeth Jewett, Cottage Grove, OR (US)

(73) Assignee: Amy Jewett, Cottage Grove, OR (US)

( * ) Notice: Subject to any disclaimer, the term of this patent is extended or adjusted under 35 U.S.C. 154(b) by 261 days.

(21) Appl. No.: 11/033,596

(22) Filed: Jan. 11, 2005

(65) Prior Publication Data

US 2006/0155332 A1 Jul. 13, 2006

Related U.S. Application Data

(60) Provisional application No. 60/535,619, filed on Jan. 12, 2004.

(51) Int. Cl.
*A61J 17/00* (2006.01)
*A63H 1/06* (2006.01)
*A63H 5/00* (2006.01)

(52) U.S. Cl. ..... 606/234; 446/266; 446/420

(58) Field of Classification Search ..... 606/234–236; 446/266, 419–421, 397
See application file for complete search history.

(56) References Cited

U.S. PATENT DOCUMENTS

| | | | | |
|---|---|---|---|---|
| 699,757 | A | 5/1902 | Howell | |
| 2,699,785 | A | 1/1955 | Allen | |
| 2,743,727 | A * | 5/1956 | Griesinger | 606/236 |
| 3,267,937 | A | 8/1966 | Verschoor | |
| 3,556,104 | A | 1/1971 | Janklow | |
| 3,669,117 | A | 6/1972 | Herbst | |
| 4,170,106 | A * | 10/1979 | Koslosky | 446/265 |
| 4,188,747 | A | 2/1980 | Kramer | |
| 5,078,734 | A * | 1/1992 | Noble | 604/77 |
| D331,783 | S | 12/1992 | Rodriguez | |
| D335,928 | S | 5/1993 | Williams | |
| 5,300,089 | A | 4/1994 | Sassin | |
| 5,344,355 | A | 9/1994 | Silverstein | |
| 5,606,871 | A * | 3/1997 | Hansen et al. | 62/457.5 |
| 5,658,314 | A | 8/1997 | Scheffer et al. | |
| 5,782,868 | A | 7/1998 | Moore, Jr. et al. | |
| 6,063,107 | A | 5/2000 | Wexler | |
| 6,292,962 | B1 | 9/2001 | Dunn et al. | |
| 6,461,214 | B1 | 10/2002 | Lynch | |
| D472,320 | S | 3/2003 | Turbeville, Jr. et al. | |
| 6,666,740 | B1 | 12/2003 | Schneider | |
| 6,736,695 | B1 * | 5/2004 | Hoch | 446/397 |
| 6,736,830 | B2 | 5/2004 | Roust | |

FOREIGN PATENT DOCUMENTS

| | | |
|---|---|---|
| DE | 19839904 | 9/2003 |
| GB | 2388041 | 5/2003 |

* cited by examiner

*Primary Examiner*—Michael J. Hayes
*Assistant Examiner*—Diane Yabut

(57) ABSTRACT

A pacifier rattle toy, with duel, gripped handles. There are gears at the end of the handles that are placed in the rattle. There are corresponding flappers to the said gears in the rattle to make a clicking noise. A feature of this pacifier toy would be a pacifier that has the capability of being locked down, and also taken off. This is useful for cleaning. Another function of this unique feature would be; if the parent chooses, for teething, the pacifier could be filled with water, and frozen. By having a pacifier on a handle you are giving the child the choice of when he/she would like to use a pacifier. This freedom encourages self-confidence. This new pacifier toy encourages fine motor skills and three of the five senses. This pacifier toy is to also include a stand by which the pacifiers may stably sit in the freezer while they are freezing.

2 Claims, 9 Drawing Sheets

PACIFIER TOY

CROSS REFERENCE

This application claims the benefit of provisional application 60/535,619 filed Jan. 12, 2004 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention relates generally to infant oral products, and entertainment. More specifically to teethers, rattles, and detachable pacifiers.

2. Background Art

Infants universally enjoy sucking and chewing on various "oral elements"; an artificial nipple, commonly termed a "pacifier", is a primary example. Another example is the large class of "teething" products designed to provide an infant relief from the pain and itching of cutting teeth. Pacifiers and teething elements come in a wide variety of sizes and shapes. However, virtually all pacifiers and teething elements are manufactured and sold as small, individual items. The problem with that is that when the infant drops the element, due to lack of coordination, the infant is unable to locate and re-grasp the element. This is frustrating for the infant, and it is also frustrating to the infant's caregiver who must go to the infant, relocate the oral element, and reposition the oral element into the infant's hand or mouth. Attempts have been made to alleviate these problems by attaching the oral element to an object via some sort of handle, toy, or tether, and thus substantially increasing the pleasure of the infant and minimizing frustration to both infant and caregiver.

This pacifier toy pertains to three categories of prior art: 1.) Pacifiers on handles, 2.) Pacifiers attached to a toy, 3.) Liquid filled, frozen pacifiers.

The various patents that have the feature of a "pacifier with a handle" are as follows: Pat. Des. 331,783 Rodriguez (1992); Des. 335,928 Williams (1993); Des. 472,320 Turbeville, Jr. et al. (2003); U.S. Pat. No. 699,757 Howell (1902); U.S. Pat. No. 2,699,785 Allen (1953); U.S. Pat. No. 3,267,937 Verschoor (1966); U.S. Pat. No. 3,556,104 Janklow (1971); U.S. Pat. No. 3,669,117 Herbst (1972); U.S. Pat. No. 6,063,107 Wexler (2000), U.S. Pat. No. 6,461,214 Lynch (2002). These devices fulfill their respective objectives. The unique feature of my invention is dual handles. These handles feature a raised, bumpy grip that offers added texture for both hands and mouth. Another way that my invention differs from the above mentioned patents is that none of them have a removable pacifier. Although U.S. Pat. No. 3,556,104 and U.S. Pat. No. 6,461,214 seem to have a removable pacifier, neither can be filled.

The various patents that have the feature of a "pacifier attached to a toy" are as follows: U.S. Pat. No. 6,292,692 Dunn et al. (2001); U.S. Pat. No. 5,344,355 Silverstein (1994), U.S. Pat. No. 4,188,747 Kramer (1980); U.S. Pat. No. 6,666,740 Schneider (2003); and foreign patents # DE19839904 Jerg Thomas, Jerg Ina (2000); GB2388041 Jones Alan Raymond (2003). These patents only further illustrate the logical idea of combining a toy and a pacifier. The unique feature over these patents is that none of these patents incorporate a rattle. Also, these six patents claim the shape of stuffed animals or dolls.

Lastly, the various patents that fit into "liquid filled, frozen pacifiers" are as follows. U.S. Pat. No. 5,658,314 Scheffer, et al. (1997); U.S. Pat. No. 6,736,830 Roust (2004); U.S. Pat. No. 5,606,871 Hansen, et al (1997); U.S. Pat. No. 5,300,089 Sassin (1994); U.S. Pat. No. 5,782,868 Moor, Jr. et al. (1998). My pacifier toy differs from this group of patents in that none of these fluid filled pacifiers have any handles. It has been mentioned in patent U.S. Pat. No. 5,606,871 Hansen et al. (1997) that "current teething ring designs are uncomfortable for the baby to hold because they are cold from refrigeration". This statement is referring to teethers such as patent U.S. Pat. No. 5,782,868, which take the form, generally, of circles, and not pacifiers. It is recognized that coolness (30 degrees to 65 degrees Fahrenheit) is soothing to babies who are teething. It would stand to reason, then, that a handle that would not get cold would make using a cold teether easier to use. Disadvantages of teethers, such as patent U.S. Pat. No. 5,782,868, which take the form, generally, of circles, is that this ring-like shape does not accommodate natural sucking or provide a natural nipple feel.

While all these devices fulfill their respective, particular objectives and requirements, the aforementioned patents do not disclose a new pacifier toy. My pacifier toy resides not in any one of these features per se, but rather in the particular combination of all of them herein disclosed and claimed and it is distinguished from the prior art in this particular combination of all of its structures for the functions specified. The general purpose of the present pacifier toy, which will be described subsequently in greater detail, is to provide a new pacifier toy which has many of the advantages of the pacifier toys mentioned heretofore and many novel features that result in a new pacifier toy which is not anticipated, rendered obvious, suggested, or even implied by any of the prior art of pacifier toys, either alone or in any combination thereof.

SUMMARY OF THE INVENTION

Accordingly, besides the objects and advantages of the pacifier toys described in the above patents, several objects and advantages of the present invention are:

(a) to provide an apparatus for satisfying the non-nutritive sucking needs of infants.

(b) to provide for the infant's non-nutritive sucking needs, while at the same time exercising, enhancing, and reinforcing the infant's grasping and fine motor skills.

(c) to provide a consistent stimulation, and enhance the child's ability to control and keep the pacifier in his/her mouth for independent sucking.

(d) to produce a child-proof method of attachment and detachment whereby only the parent/caregiver can detach the pacifier from the toy so that the child cannot detach and lose the pacifier by manipulation or pulling.

(e) to provide for the infant's need for psychological stability, which is supposed to be the function of the pacifier.

(f) to produce a new and improved infant pacifier construction which can be manufactured at a low cost with regard to both materials and labor, and which, accordingly, is then offered to the consuming public at a low price, thereby making such infant pacifier construction economically available to the buying public.

(g) to provide a pacifier toy that is manufactured from a non-allergenic, nontoxic, material that has a soft texture, and is flexible, long-wearing, scuff resistant, heat resistant, durable in construction, and inexpensive. As such, my pacifier toy is also easily cleaned and sanitized by any number of techniques. For example, my pacifier toy can be sterilized in hot water, or with alcohol. It can be manually washed with conventional soap and water. Moreover, my pacifier toy can also be easily cleaned automatically in a dishwasher.

Further objectives and advantages are to provide an alternative for the occasions when a proper feeding schedule cannot be complied with. A child, anticipating being fed on schedule, may become irritable, and even psychologically frustrated, unless the feeding is in some way simulated. A further objective and advantage of this pacifier toy would be the alternative of using some other object, for example, a mirror, to be used in place of the pacifier once it comes time to wean. When a pacifier is combined with a toy the eventual weaning, or elimination of the pacifier, is less traumatic for the child. When the parent weans the child from the pacifier, the child still has the comfort of the toy with which he/she has associated fun and comfort since infancy. After the infant has matured to the point where the need for a pacifier has passed, certain embodiments of my invention include a unique alternative, for example a mirror, to entertain the child in a new way, in hopes of forgetting about the absent pacifier. The child will first look for the pacifier, but quickly accept the toy on its own without the pacifier. In previous combinations, the aesthetic effect when the pacifier is removed is displeasing and awkward since the removal of the pacifier leaves an empty receptacle on the doll or animal with no purpose. In the present invention, the toy looks absolutely normal with no unnatural appearing empty spaces when the pacifier is removed. This is because it can be replaced with objects, for example, a mirror, to fill in the empty space. Not only does this help with the weaning process, it helps to keep the child interested in the toy longer, as he/she will have new parts of the toy to play with.

Still yet another objective of the present invention is to provide a new and improved infant pacifier toy that provides in the apparatuses and methods of the prior art some of the advantages thereof, while simultaneously overcoming some of the disadvantages normally associated therewith.

These, together with other objects of the invention, along with various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

The present invention is a combination of a traditional pacifier and a dual handled rattle. A main purpose of this pacifier toy is to give the child the choice of when he/she would like to be using the pacifier. The pacifier can be removed by a child-proof locking mechanism. This provides for ease of cleaning, the ability for filling, freezing, teething, and weaning purposes. The dual handles are gripped for ease of holding, and also for an additional teething surface. The handles have gears inside the rattle for extra sound sensory pleasure when turned. A "stand" to be provided either with toy as a "kit", or sold separately to hold the pacifiers in the freezer. This pacifier toy would be most appropriate for children ages six months and older.

Thus the reader will see that the pacifier toy of this invention provides constant stimulation for a child through the stages of needing the comfort of the pacifier, teething, and weaning of the pacifier. The different textures on the handle, the use of colors, and the use of gears and rattles stimulate three of the five senses. These are touch, sight, and sound. Furthermore, the pacifier toy has the additional advantages in that:

it provides the ability to be able to be removed from the pacifier for ease of cleaning.

it provides another advantage with this capability. This advantage is the ability for filling it with water for freezing, to ease in teething.

it provides the child the power to choose whether he/she would like to be using a pacifier or not.

it provides the child the ability to tune fine motor skills, and is easily grasped.

All of these features to be provided with the use of lightweight, non-toxic materials, that are inexpensive for the consuming public.

While my above description contains certain specifications, these should not be construed as limitations on the scope of the invention, but rather as an exemplification of the preferred embodiment thereof. Other variations are possible. For example, there may be four handles, each at a corner of the "rattle". The rattle itself may take on any shape such as a bird, or a butterfly, for appeal to the purchaser as well as the child. The "preferred embodiment" described in this patent is the most generic way thought to describe the pacifier toy. I would expect the pacifier toy to take on many different shapes and sizes and colors. It can be made of any type of materials from wood to different plastics for the body; and rubber, vinyl, silicone or plastic for the pacifier.

While a particular embodiment of this new pacifier toy has been shown and described, various modifications thereof will be apparent to those skilled in the art and, therefore, it is not intended that the invention be limited to the disclosed embodiment or to the details thereof, and departures may be made therefrom within the spirit and scope of the invention as defined in the appended claims and their legal equivalents.

DRAWINGS—FIGURES

Figure 1:
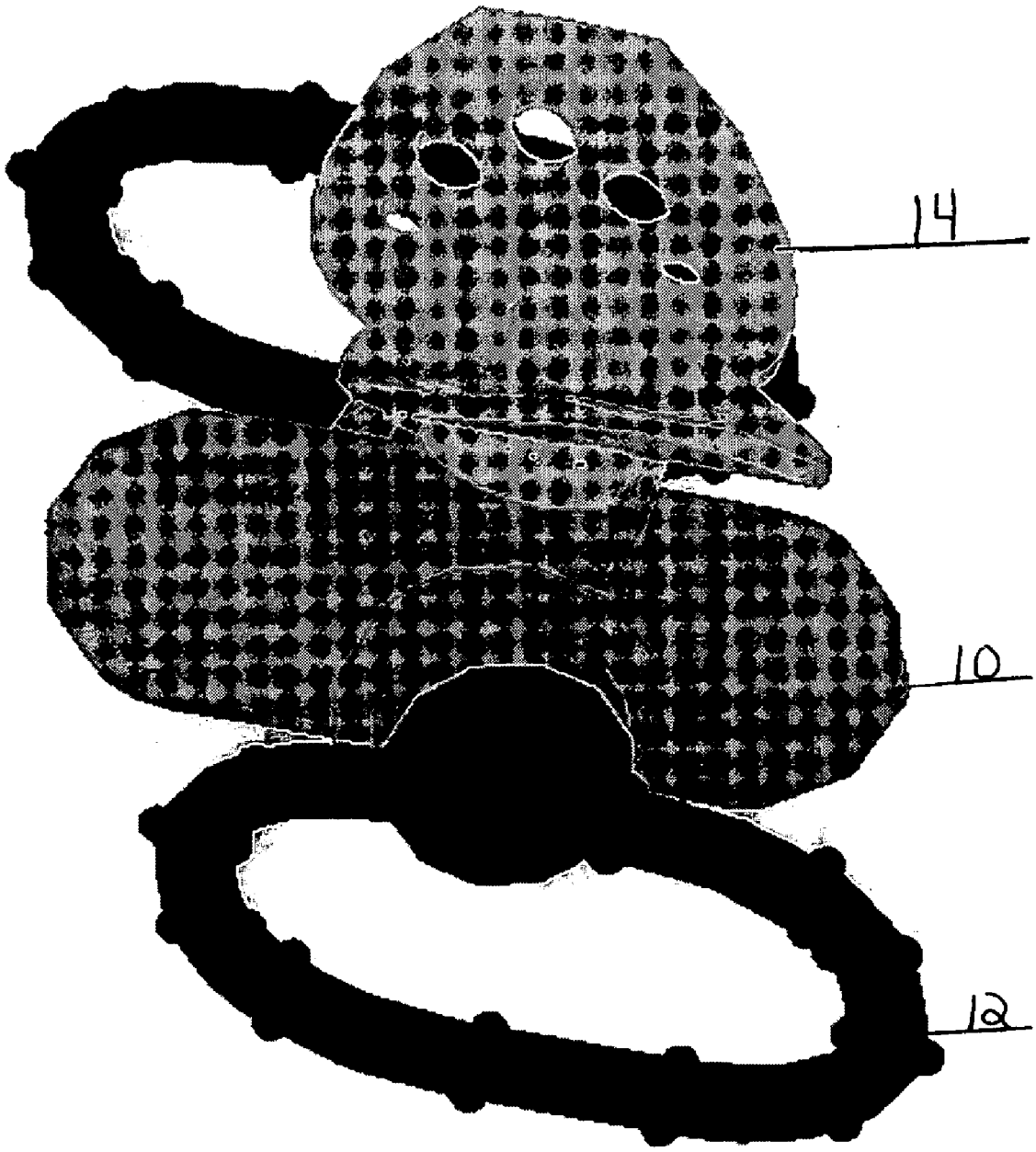
FIG. 1 shows a rendered view of the pacifier toy

| DRAWING-Reference Numerals |
|---|
| 10 rattle housing |
| 12 handle |
| 14 removable pacifier |
| 16 balls |
| 18 screw holes |
| 20 gears |

-continued

| DRAWING-Reference Numerals |
|---|
| 22 flapper |
| 24 seal |
| 26 solid piece of plastic |
| 28 locking mechanism on rattle |
| 30 shield |
| 32 nipple |
| 34 locking mechanism on pacifier |
| 36 textured grip |
| 38 stand |

DETAILED DESCRIPTION—FIGS. 1-9—PREFERRED EMBODIMENT

Figure 2:
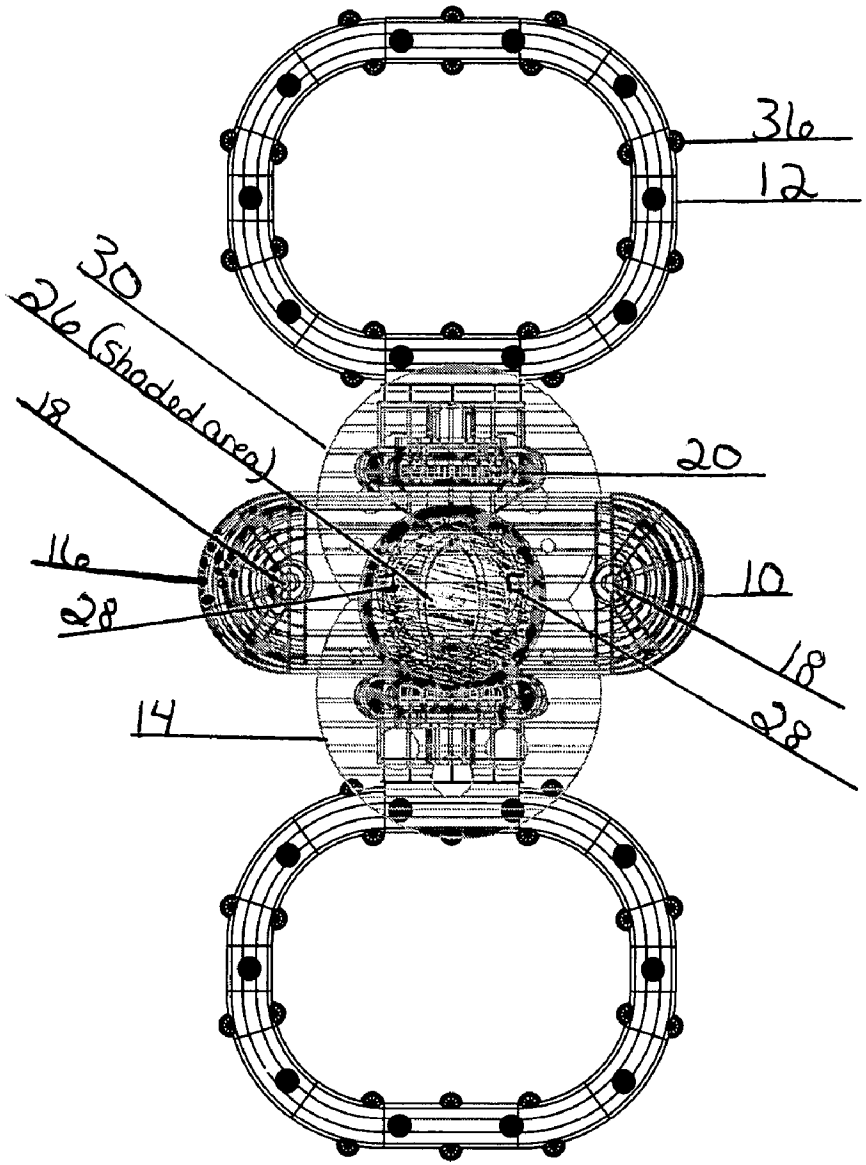
FIG. 2 shows the pacifier toy from a frontal view, and has most parts included
Figure 5:
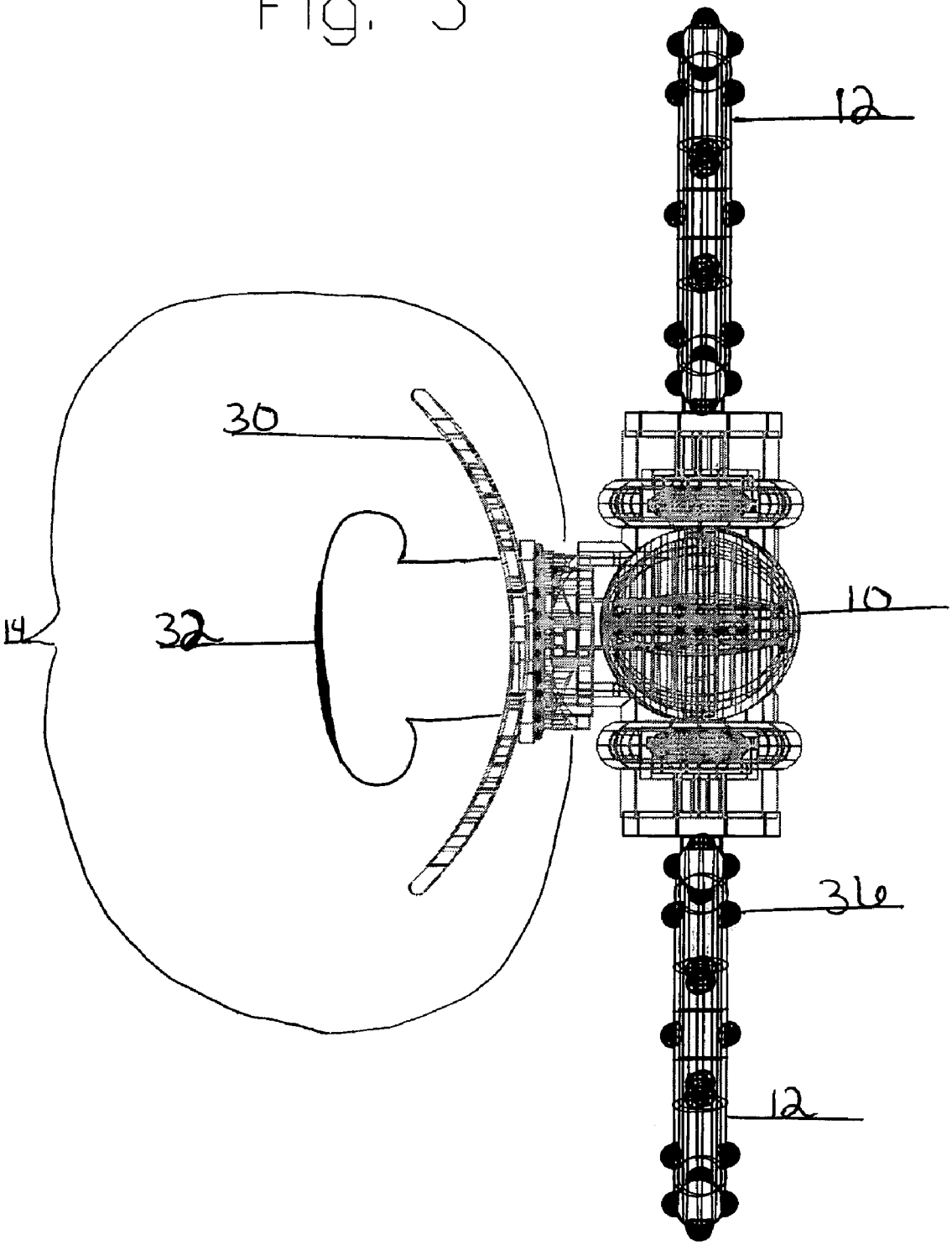
FIG. 5 shows side view of the pacifier toy

A preferred embodiment of the pacifier toy of the present invention is illustrated in FIGS. 1, 2, and 5. This pacifier toy has three main components, a rattle housing 10, a handle 12, and a removable pacifier 14.

Figure 3:
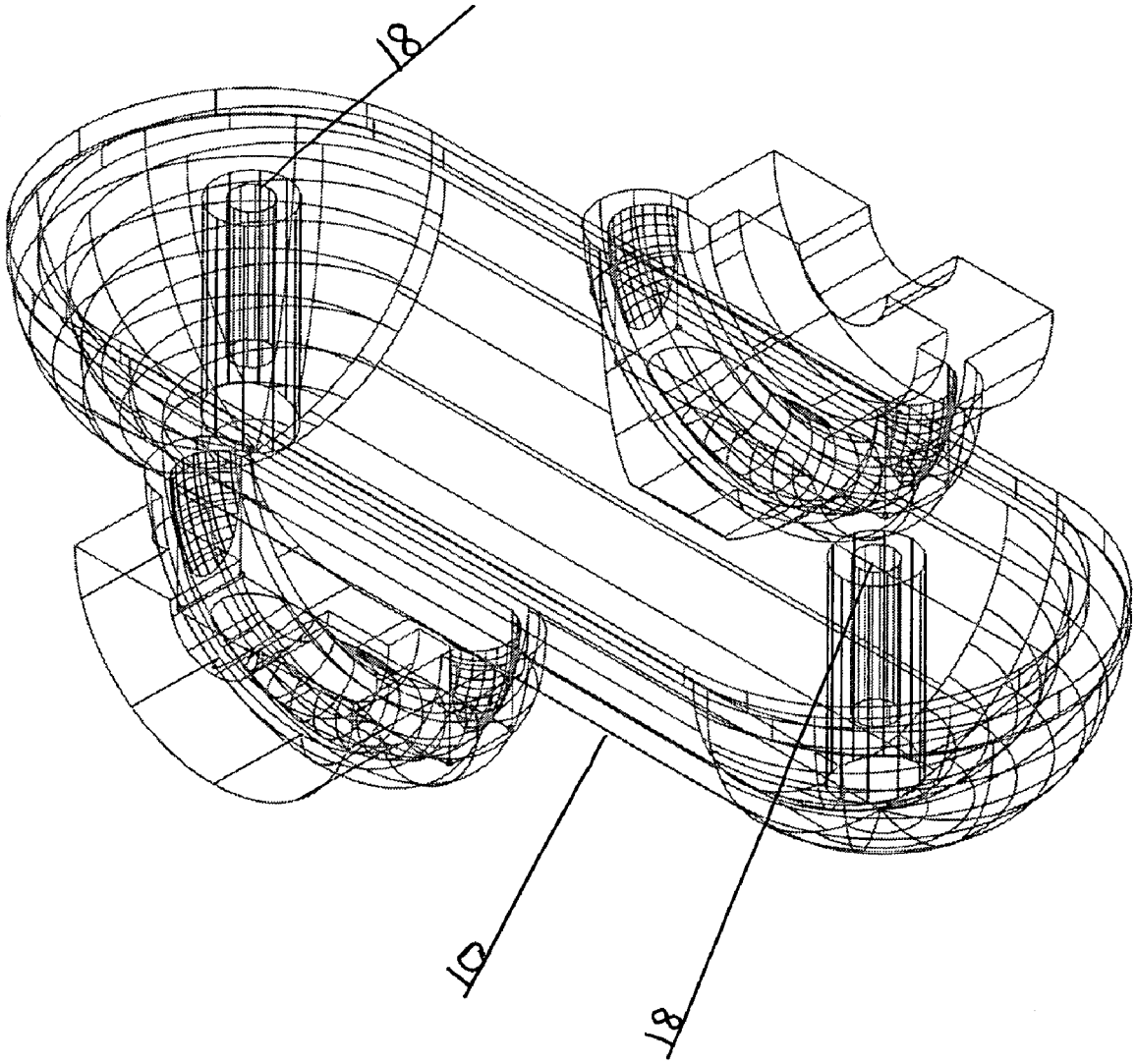
FIG. 3 shows top half of rattle housing
Figure 4:
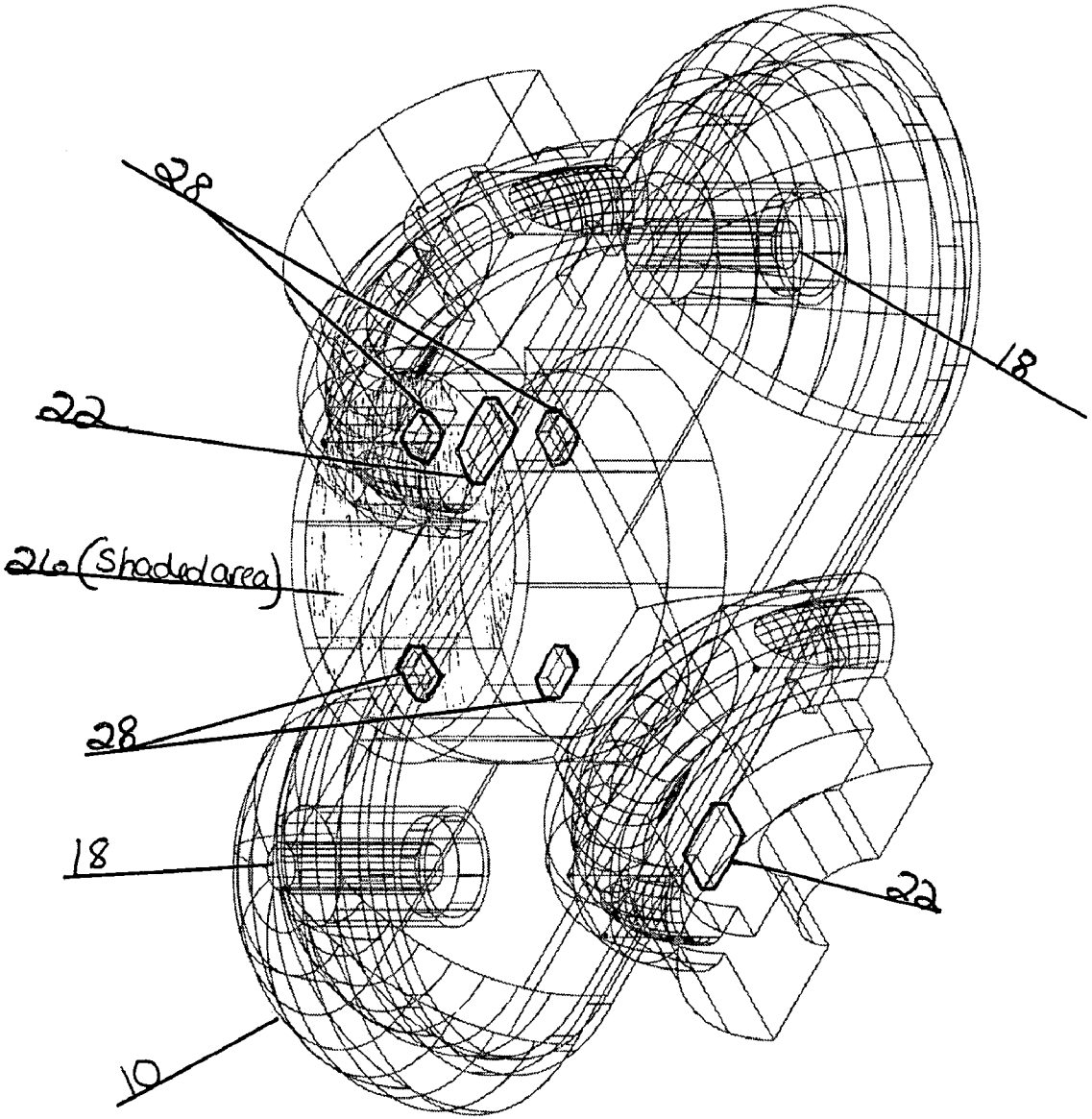
FIG. 4 shows bottom half of rattle housing
Figure 6:
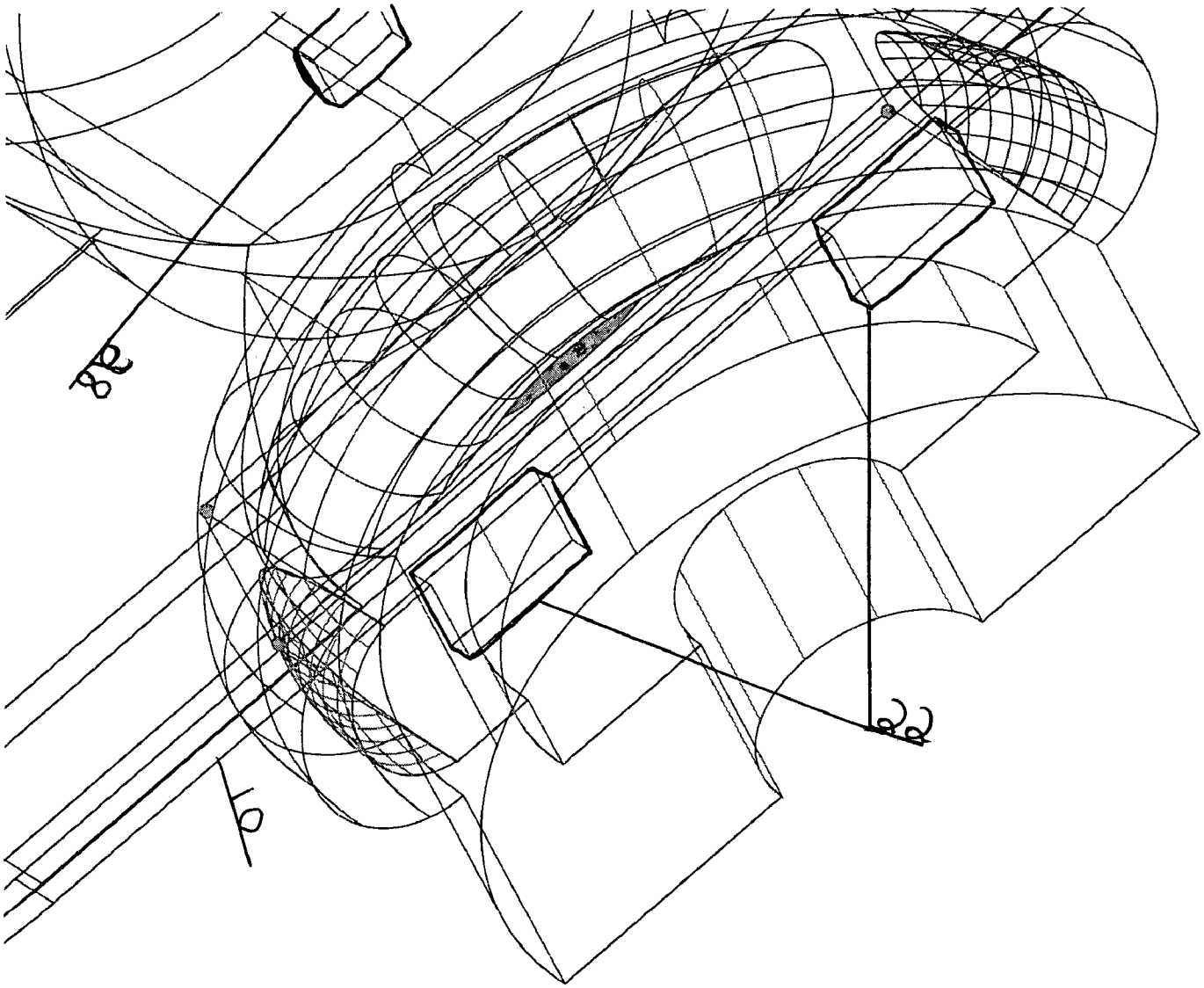
FIG. 6 shows flappers inside rattle

There are five objects of the rattle housing 10. First are balls 16. There are a number of these little balls placed in the rattle housing 10, so that when the toy is shaken around it will make a noise. These can be made out of any material, preferably plastic, as this is the least expensive. The second object of the rattle housing 10 is screw holes 18. I have included two in my preferred embodiment, but I think three will give it the best support. These screw holes 18 serve the purpose of closing the top and bottom half of the rattle housing 10. You can see an illustration of the top and bottom halves in FIGS. 3 and 4. The third object of the rattle housing is flappers 22 as shown in FIG. 6. These are located inside the rattle housing 10 where the handle 12 enters and rests in the rattle housing 10. The purpose of the flappers 22 is to be struck against gears 20 on the end of the handle 12. The flappers 22 are shown to be rectangular in shape in my preferred embodiment. To this end, a noise will be made when the child turns the handles. The fourth object of the rattle housing is a solid piece of plastic 26 which is located on the inside of the rattle housing 10 at the rear of the hole to where the removable pacifier 14 is screwed on. The purpose of this solid piece of plastic 26 is so water cannot seep into the rattle housing 10. The fifth and last object of the rattle housing 10 is a locking mechanism 28.

This is an extension of the rattle housing 10 so that locking mechanism 34 from the removable pacifier 14 can mate up, and the child cannot remove the pacifier 14 by his/her self.

Figure 7:
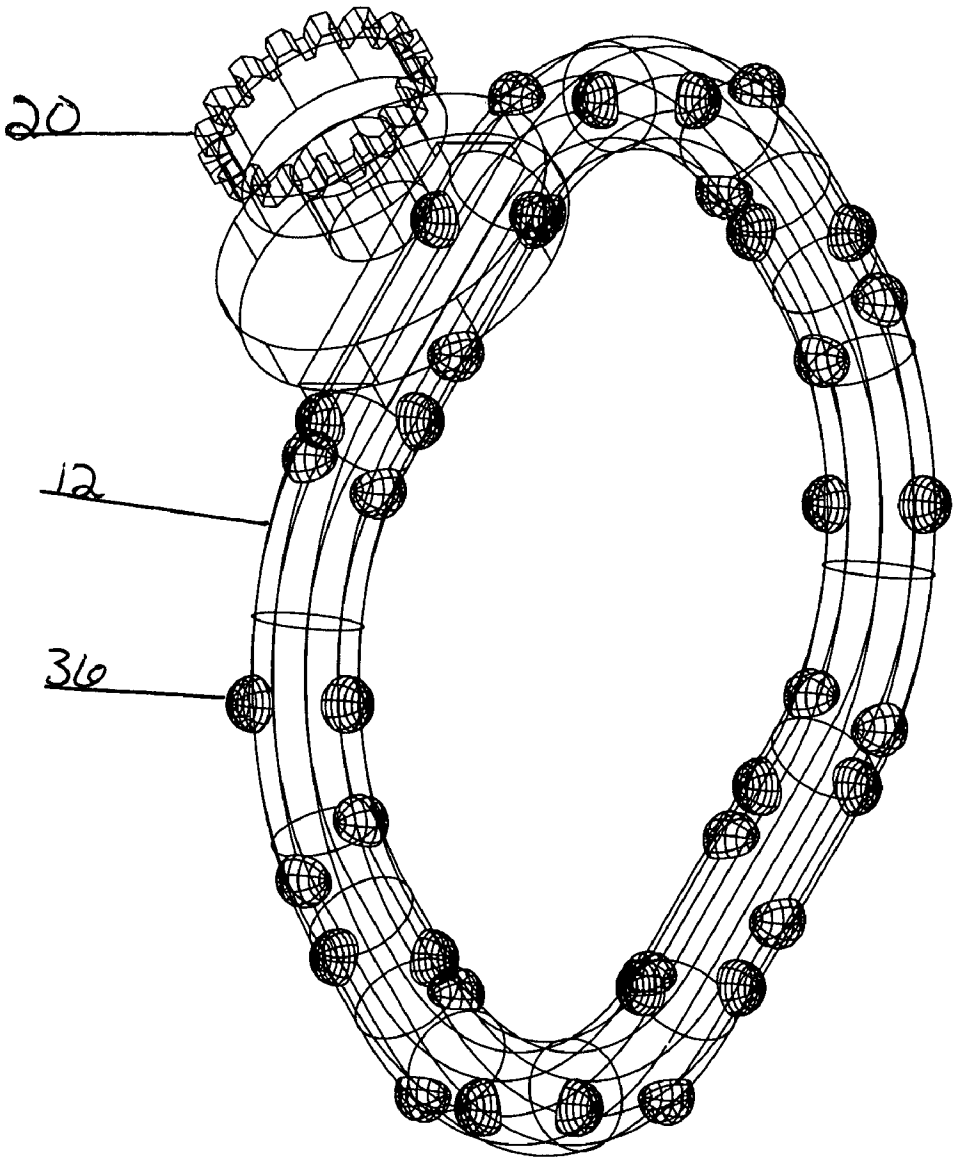
FIG. 7 shows handle with gears

There are two objectives of the handles 12 shown in FIG. 7. The first objective of the handles 12 is gears 20. These are located at the end of the handle 12, which is placed in the rattle housing 10. When the handle 12 is turned, the gears 20 also spin and strike against the flappers 22, to make a pleasant noise. The second objective of handle 12 is textured grip 36. The purpose of this textured grip 36 is for ease of handling for a child. When a child is teething, saliva may be coming out at all times, and thus a textured grip 36 will make it easier for a child to keep a grip when wet. Another advantage to the textured grip 36 would be another surface for the child to mouth on.

Figure 8:
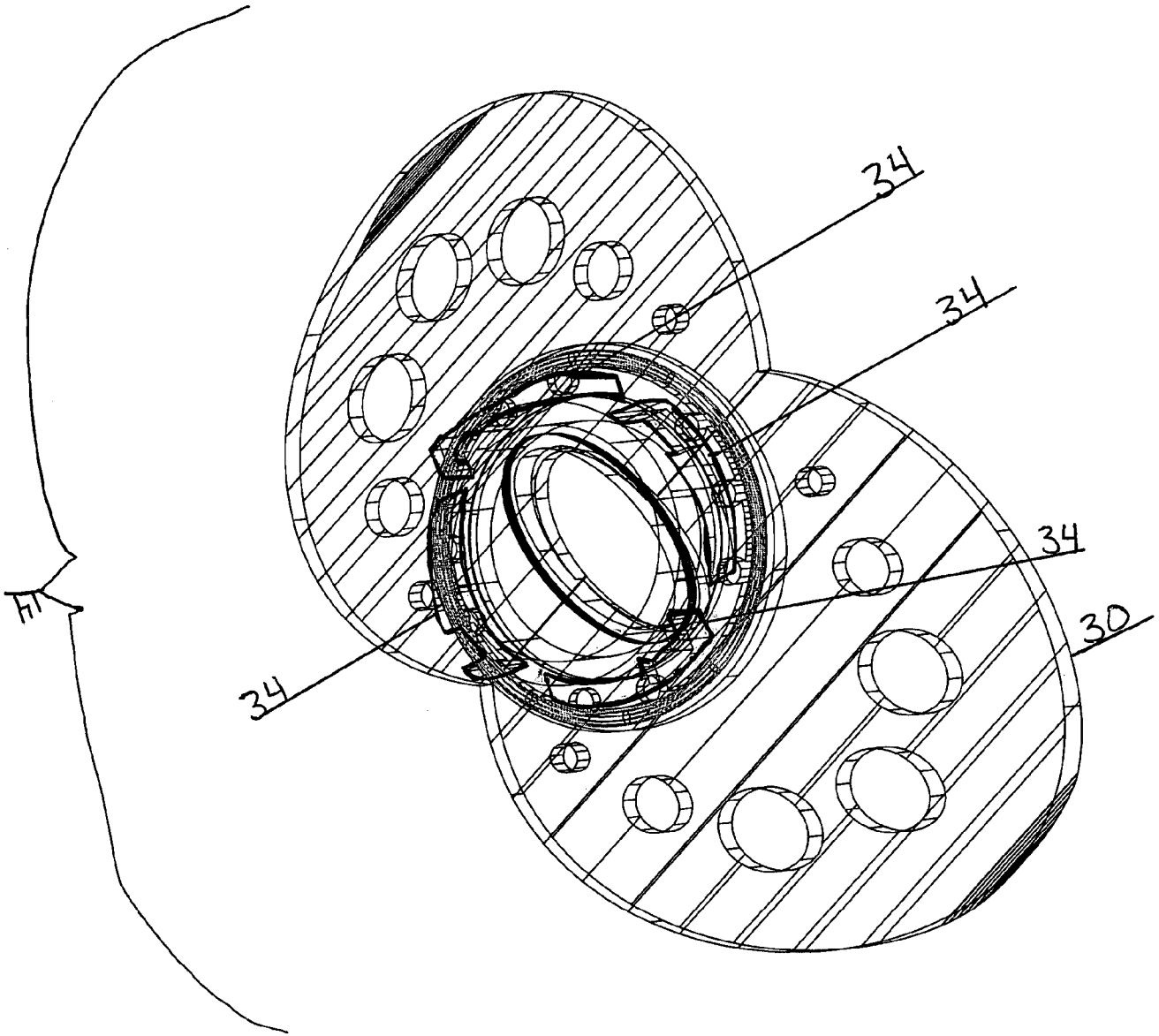
FIG. 8 shows pacifier from behind

There are four objectives to the removable, fillable pacifier 14. The first objective of the pacifier 14 is a shield 30. It is well known in the use of pacifiers that shields are used so that children are not able to swallow, and choke on the pacifier. The shield also has breather holes to allow for sufficient air flow. A feature of the shield is the hole in the middle to allow for nipple 32 to be placed through, and secured. The second objective of the pacifier 14 is nipple 32. The nipple in my preferred embodiment is hollow. This allows for filling with water. The third objective of the pacifier 14 is locking mechanism 34. This locking mechanism 34 is placed on the opposite side of the nipple. This locking mechanism 34 corresponds to locking mechanism 28 on the rattle housing 10. When these two locking mechanisms are locked together, the child is prevented from removing the pacifier him/herself. The fourth and last objective of the pacifier 14 is seal 24. This is simply a rubber gasket that is placed at the end of the locking mechanism where it will butt up against the solid plastic piece 26, and prevent any water from leaking out. The shield 30, and the seal 24 can be found in FIG. 8. The nipple 32, and the locking mechanism 34, can be found in FIG. 9.

Figure 9:
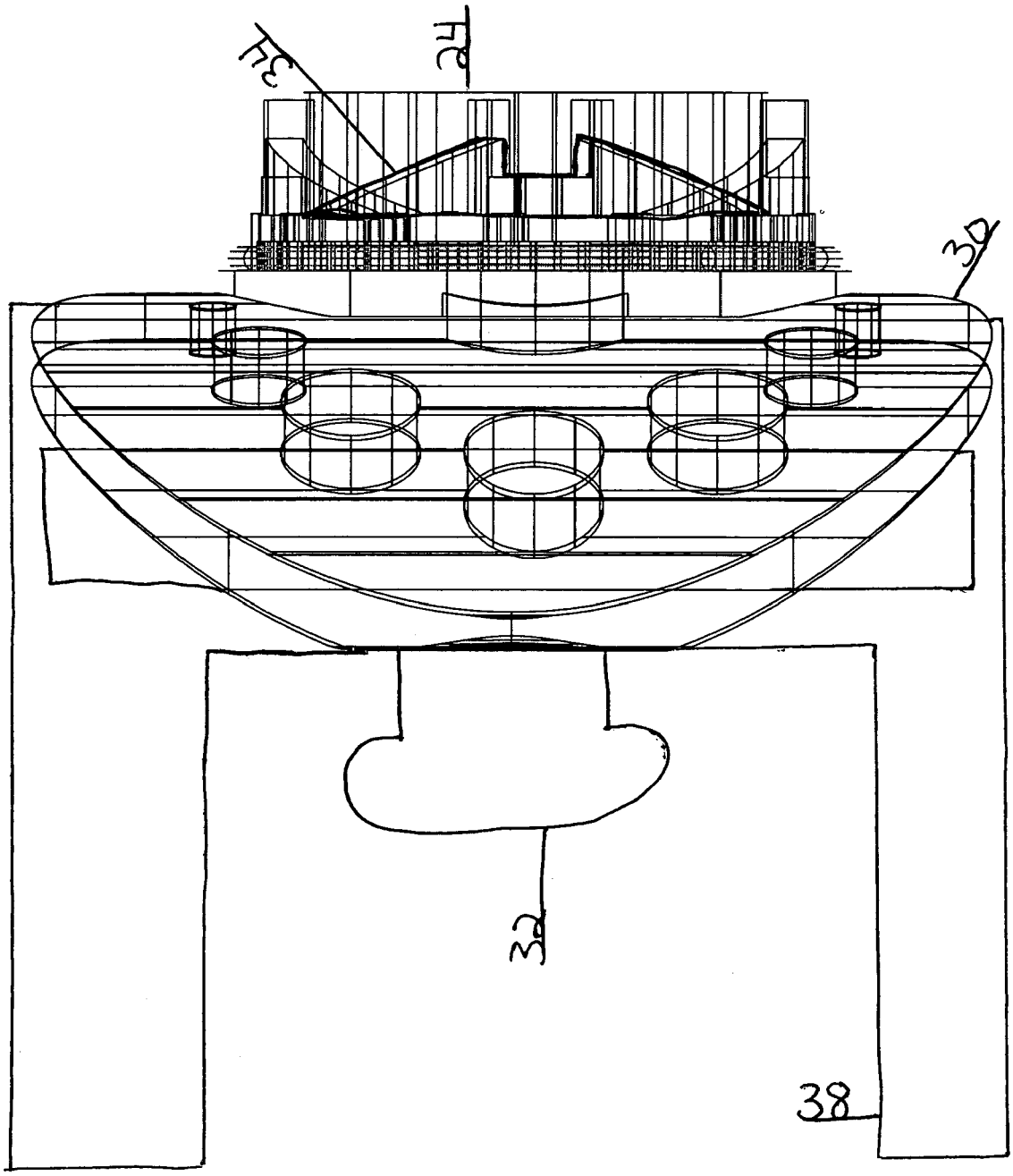
FIG. 9 shows pacifier on stand

The last thing to mention about the present invention is a stand 38, which is shown in FIG. 9. This is a pacifier holding device for use in the freezer. This can be made of any material, preferably plastic, as this is the least expensive. It could hold just one pacifier, or many pacifiers.

OPERATION OF INVENTION

The manner of using this new pacifier toy should be fairly simple. First, and foremost, it is a toy for a child. He/she must simply pick it up and shake it around to hear the pleasant noise of the rattle. In picking it up by the handle or handles, and spinning them, you would also hear another pleasant sound. These handles would be slim enough for a small child to manage easily. There is a pacifier attached to this pacifier toy. This may be screwed in and out by an adult for ease of cleaning, and also to allow for filling and freezing to ease the discomfort of teething. The child, then, has the choice as to when he/she would like to be using a pacifier. This will help the child to be less dependent on a pacifier, and more socially adaptable.

Additional Embodiments

There are various possibilities with regard to what can be done alternatively with the pacifier toy. These include:

The main body may take on any form at all. Examples include a person, a shape, or an animal.

The grip on the handles may be of any sort. Examples include bumps, ridges, lines, shapes, etc.

The body, handles, pacifier, and rattle balls may be of any suitable material. Examples include wood, or different plastics.

The pacifier may or may not screw out and in to be filled.

The pacifier may already come pre-filled with some type of fluid from the manufacturer. Examples include water, food grade glycerin, a freezable gel, or food grade propalyne glycol.

The color of the entire object may be of any color, or void of color (clear).

The stand for the pacifier in the freezer may be made of any material, and take on any form, to allow any number of pacifiers to sit on it.

The way the nipple is held in place in the shield may be of different sorts, preferably the safest way, which, including the thick rubber around the hole, could include, but is not limited it to, safety pins of plastic or metal to run through the rubber, and securely attach it to the shield. Another possibility would be to have a plug to place in the nipple before freezing to help the nipple stay attached to the shield.

Another option may be to use the technology of ultrasonic welding.

There may be the use of different kinds of nipples. Examples include nipples that are anatomically correct, and use of double walled nipples.

There may be some sort of a mark placed on the nipple to show where to stop filling the water to avoid overfilling, and thus bursting the nipple when frozen.

I claim:

1. A pacifier toy combination for satisfying the nonnutritive, stimulatory, and teething needs of infants comprising:

a) a rattle housing, cylindrically shaped, having rounded ends, and a cross section where handles are to sit and spin placed halfway down the cylinder;

b) two handles located on opposing sides of the rattle housing for holding the toy combination, said handles having the ability to spin and each of said handles having a gear at one side;

c) a removable, locking, fillable pacifier having a locking mechanism on one side and a hollow nipple on the opposite side;

d) said rattle housing having a second locking mechanism that corresponds to said locking mechanism on said pacifier, wherein said locking mechanisms correspond to prevent the infants from removing said pacifier from said rattle housing;

e) flappers located in said rattle housing, wherein when said handles are spun said gears strike said flappers to make noise; and f) a rubber gasket placed at the end of said pacifier locking mechanism.

2. A pacifier toy combination as recited in claim 1 and further comprising:

a) a stand with which to hold said pacifier in the freezer.

* * * * *